US008177952B2

(12) United States Patent
Kang et al.

(10) Patent No.: US 8,177,952 B2
(45) Date of Patent: May 15, 2012

(54) PREPARATION METHOD OF URANIUM METAL AND APPARATUS THEREUSED

(75) Inventors: Young-Ho Kang, Daejeon (KR); Jong-Hyeon Lee, Daejeon (KR); Sung-Chan Hwang, Daejeon (KR); Joon-Bo Shim, Daejeon (KR); Eung-Ho Kim, Daejeon (KR); Sung-Won Park, Daejeon (KR)

(73) Assignees: Korea Atomic Energy Research Institute, Daejeon (KR); Korea Hydro & Nuclear Power Co., Ltd., Seoul (KR)

( * ) Notice: Subject to any disclaimer, the term of this patent is extended or adjusted under 35 U.S.C. 154(b) by 535 days.

(21) Appl. No.: 11/649,407

(22) Filed: Jan. 3, 2007

(65) Prior Publication Data

US 2007/0158196 A1 Jul. 12, 2007

(30) Foreign Application Priority Data

Jan. 11, 2006 (KR) ..... 10-2006-0003317

(51) Int. Cl.
*C25C 3/34* (2006.01)

(52) U.S. Cl. ..... 205/46; 205/48

(58) Field of Classification Search ..... 205/44, 205/46, 48

See application file for complete search history.

(56) References Cited

U.S. PATENT DOCUMENTS 2,902,415 A * 9/1959 Niedrach et al. ..... 205/47
3,140,151 A * 7/1964 Stransberg et al. ..... 423/3
4,067,787 A * 1/1978 Kastening et al. ..... 205/466
5,264,159 A * 11/1993 Ikeda et al. ..... 588/20
5,348,626 A * 9/1994 Miller et al. ..... 205/44
7,097,747 B1 * 8/2006 Herceg et al. ..... 204/201

OTHER PUBLICATIONS

Konstantin V. Emtsev, Thomas Seyller, Florian Speck, Lothar Ley, P. Stojanov, J.D. Riley, R.C.G. Leckey, "Initial Stages of the Graphite-SiC(0001) Interface Formation Studied by Photoelectron Spectroscopy" Sep. 17, 2007, Trans Tech Publications, Material Science Forum vols. 556-557 (2007) pp. 525-528.*

Ahluwalia, et al., "Uranium Transport in a High-Throughput Electroefiner for EBR-II Blanket Fuel", Nuclear Technology, vol. 145, pp. 67-81, Jan. 15, 2004.

(Continued)

*Primary Examiner* — Keith Hendricks
*Assistant Examiner* — Susan D Leong
(74) *Attorney, Agent, or Firm* — Perkins Coie LLP

(57) ABSTRACT

Disclosed herein is a method of preparing uranium metal by electrorefining uranium metal, comprising: applying a predetermined current to an anode electrode included in an anode basket receiving fuel segments made of uranium metal and a cathode electrode of carbon material; electrodepositing uranium on the cathode electrode in accordance with the reaction initiated by the applied current; and collecting the electrodeposited uranium by self-weight. An apparatus for electrorefining uranium metal used in the method according to the present invention, comprises: an anode basket (6) receiving fuel segments made of uranium metal and comprising an anode electrode; and a reactor including a cathode electrode (5) made of carbon material and a uranium collector (10) therein. According to the method of the present invention having the above mentioned constitution and the apparatus thereof, it is possible to separate only pure uranium metal with a high capability from the spent metal nuclear fuels conveniently and economically.

12 Claims, 4 Drawing Sheets

OTHER PUBLICATIONS

Iizuka, et al., "Engineering-Scale Elecrefining Test with U-Zr Alloy Anode Containing Simulating Fission Product Elements", Central Research Institute of Electronic Power Industry, Present Study is the Result of "Development and Improvement of Electrometallurgical Process", pp. 1-23, 2008.

Inoue, et al., "Development of Pyroprocessing and its Future Direction", Nuclear Engineering and Technology, vol. 40, No. 3, pp. 183-190, Apr. 2008.

Lee, et al., "Electrodeposition Characteristics of Uranium in Molten LiCl-KCl Eutectic and its Salt Distillation Behavior", Journal of Nuclear Science and Technology, vol. 43, No. 3, pp. 263-269, Mar. 27, 2006.

Kang et al., "Electrodeposition Characteristics of Uranium by Using a Graphite Cathode," Mar. 3, 2006, pp. 3142-3145, Korea Atomic Energy Research Institute, Daejeon, Republic of Korea, © 2006 Elsevier Ltd.

* cited by examiner

[Fig. 1]

[Fig. 3]
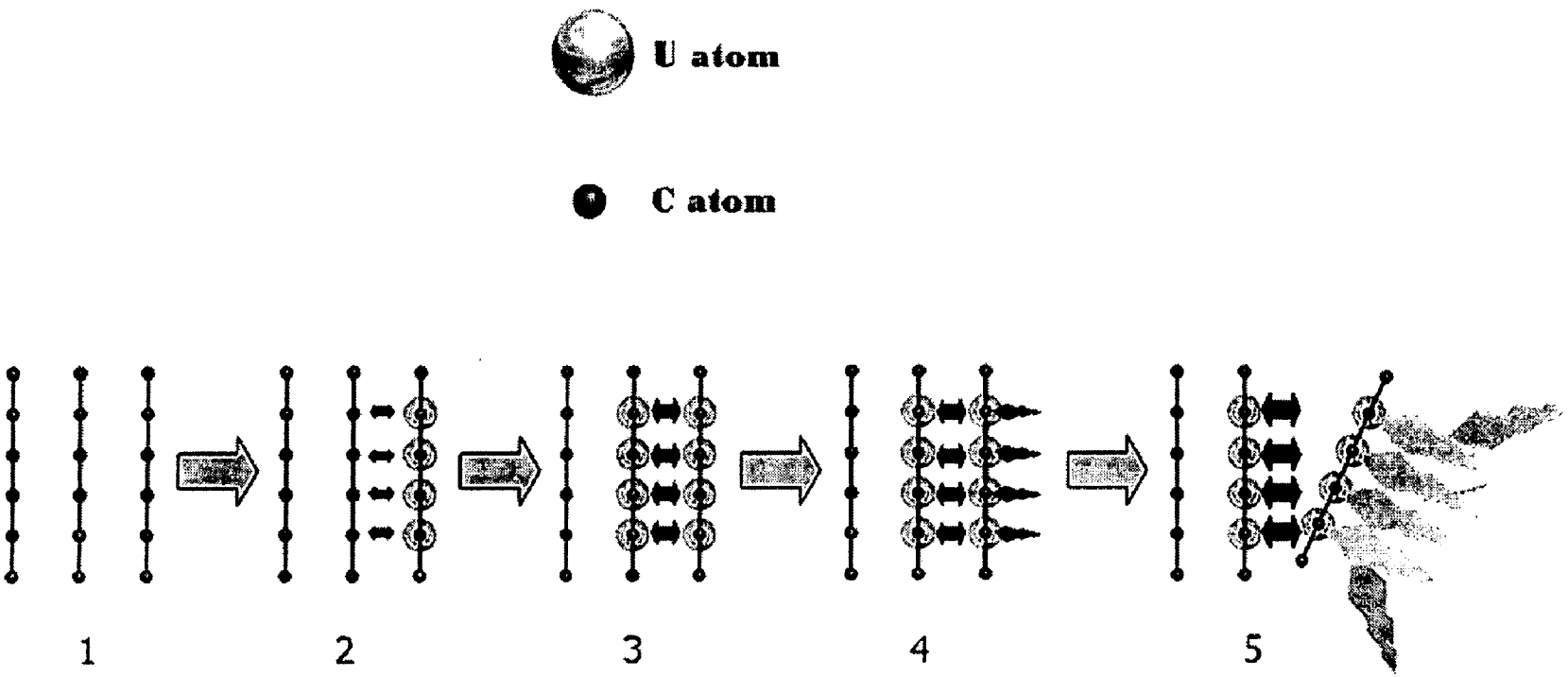

[Fig. 4]
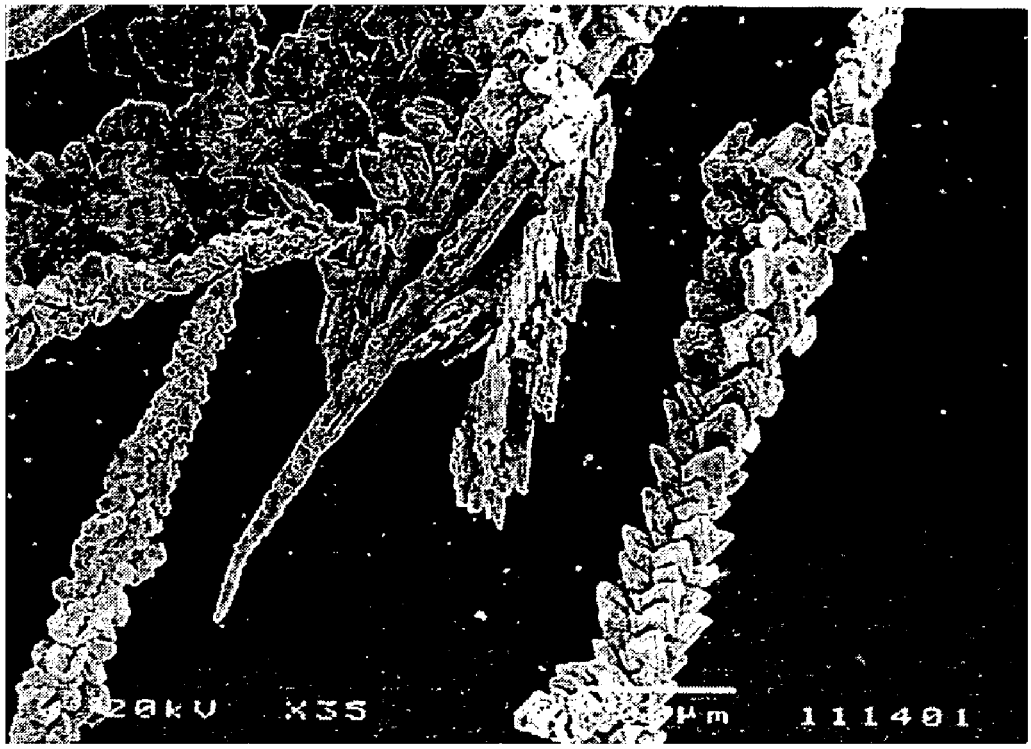

PREPARATION METHOD OF URANIUM METAL AND APPARATUS THEREUSED

CROSS REFERENCE TO RELATED APPLICATION

This application claims priority to Korean Application No. 10-2006-0003317 filed on Jan. 11, 2006 under 35 U.S.C. §119 and is incorporated herein by reference.

BACKGROUND OF THE INVENTION

1. Field of the Invention

The present invention relates, generally, to methods for preparing uranium metal and apparatus thereused, more particularly, to methods for preparing uranium metal capable of separating pure uranium metal with high capability from the spent metallic nuclear fuels generated in an atomic power plant conveniently and economically and an apparatus thereused.

In a uranium metal electrorefining, if the sections of the used metal fuels are put in an anode basket within a molten salt at 500° C. where uranium trichloride is melted and a current is applied using a metal rod such as iron as cathode, the uranium trichloride in the molten salt is deposited. In this reaction, the separated chloride ions electrically dissolve uranium metal in the anode and can separate pure uranium metal at the cathode. However, this method is disadvantageous in that the reaction occurs at a low speed thus a great amount of products are not obtained within a short time.

2. Description of the Related Art

In the method for separating a uranium metal with a high capability, as shown in U.S. Pat. Nos. 5,650,053 and 6,365,019 and application No. 2004/01347851A1, the sections of the spent metal fuels in the molten salt at 500° C. are put in an anode basket of a perforated plate and placed in and out the cathode formed in a tube type, consisting of several anode baskets, and then if an electricity is applied with rotating the anode basket, the uranium metal in the anode is dissolved out to be deposited in the cathode and the deposited uranium is scraped downwardly by a ceramic plate attached the outside of the anode and collected in the lower collecting apparatus. However, as the apparatus partially detach the electrodeposited uranium metal, the remaining electrodeposits continue to stick on the cathode surface. Accordingly, the sticking electrodeposits become a compact tissue which is difficult to be detached and the anode ceramic plate cannot detach this compact electrodeposites. Therefore, if the electrorefining is stopped after a certain time passes, and an electricity is inversely applied, the compactly sticking uranium eletrodeposites are return back to anode and stripped. After the cathode surface is cleaned, the operation for electrodepositing is needed again. This operation is disadvantageous in that a great amount of electricity is consumed and the electrodeposition capability is very ineffective, thus the apparatus is very complicated.

In order to solve the above disadvantage, the US Argonne National Laboratory developed a new apparatus called Plannar electrode Electrorefiner (PEER) at http://www.cmt.anl.gov. The apparatus is designed to deposit an anode including a metallic fuel in the middle and a plurality of cathodes therearound and operate an electrolytic reaction. After a certain time passes, the eletrodeposites are attached on the cathode and a porous ceramic plate is moved in a vertical direction to scrap out the cathode electrodeposites. However, this method is disadvantageous in that the electrodeposites are intervened between the hole of the ceramic plate and a metal cathode to prevent the vertical movements, and the complicated apparatus is not greatly improved. Especially, the method is also disadvantageous in that a process for removing the electrodeposites sticked on the cathode via the stripping process using the second cathode is included to degrade the efficiency of a current greatly.

SUMMARY OF THE INVENTION

Accordingly, the present invention has been made keeping in mind the above problems occurring in the related art, and an object of the present invention is to provide a method of preparing only pure uranium metal with high capability from the used metallic fuels generated from the reactor and the fuels resolved into metals conveniently and economically.

Another object of the present invention is to provide an apparatus for electrorefining uranium metal, which can separate only pure uranium metal with high capability from the used metallic fuels generated from the reactor and the fuels resolved into metals conveniently and economically.

In order to accomplish the above objects, the present invention provides a method of preparing uranium metal via an electrorefining of uranium metal, comprising: applying a predetermined current to an anode electrode included in an anode basket receiving uranium metal segments containing plutonium and miner actinide and a cathode electrode of carbon material within a molten salt containing uranium trichloride; electrodepositing uranium to the cathode electrode in accordance with the response disclosed by the applied current; and collecting the electrodeposited uranium by self-weight.

It is preferable that the present invention provide a method of preparing uranium metal via an electrorefining of uranium metal, wherein the carbon material is one selected from the group consisting of graphite, glassy carbon and glassy graphite.

It is preferable that the present invention provide a method of preparing uranium metal via an electrorefining of uranium metal containing plutonium and miner actinide, wherein the current density not less than 140 $mA/cm^2$ is provided.

In addition, the present invention provides an apparatus for electrorefining uranium metal, comprising: an anode basket receiving uranium metal segments containing plutonium and miner actinide and comprising an anode electrode; and a reactor including a cathode electrode made of carbon material and a uranium collector therein.

It is preferable that the present invention provide an apparatus for electrorefining uranium metal, wherein the carbon material is one selected from the group consisting of graphite, glassy carbon and glassy graphite.

It is preferable that the present invention provide an apparatus for electrorefining uranium metal, wherein a plurality of cathode electrodes are deposited around the anode basket.

It is preferable that the present invention provide an apparatus for electrorefining uranium metal, wherein the plurality of cathode electrodes are deposited in a concentric circle around the anode basket.

BRIEF DESCRIPTION OF THE DRAWINGS

FIG. 3 schematically shows a process for excluding uranium metal deposited on the cathode electrode made of carbon material.

FIG. 4 is a drawing showing that uranium deposited and excluded using a carbon rod as a cathode and collected from the lower uranium collector observed by a scanning electron microscope.

DESCRIPTION OF THE PREFERRED EMBODIMENTS

Hereinafter, the present invention now will be described with reference to the drawings showing the preferred embodiments of the present invention.

Figure 1:
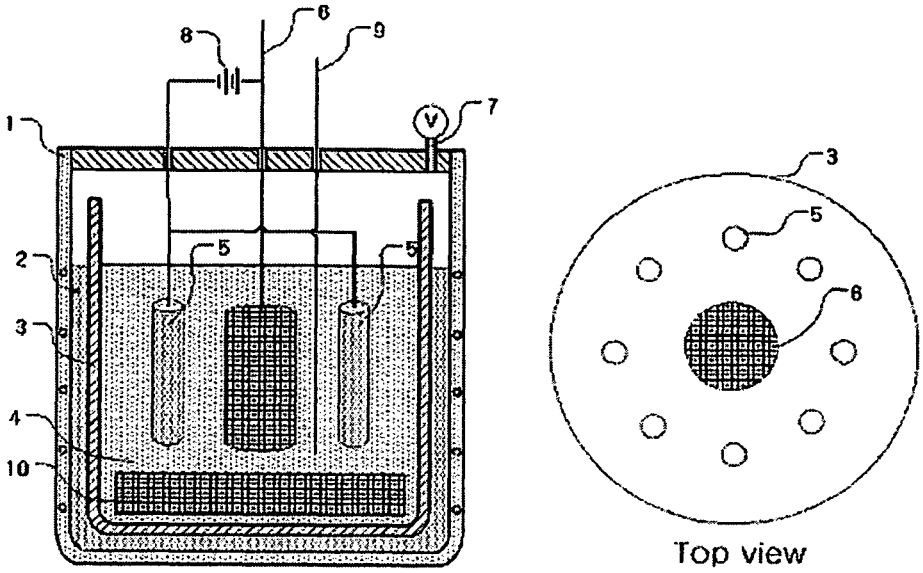
FIG. 1 is a mimetic view showing an uranium electrorefining reactor equipped with a cathode electrode of carbon material.

FIG. 1 is a mimetic view showing an uranium electrorefining reactor equipped with a cathode electrode of carbon material. The apparatus for electrorefining uranium metal in accordance with the present invention includes a reactor (1), an insulator (2), a stainless steel reactor (3), a molten salt (4), a carbon material cathode (5), an anode basket (6), an Argon gas valve (7), a power supply (8), a thermocouple (9) and an uranium collector (10).

It is preferable that the anode basket (6) which is made of the material of a perforated plate have sections of waste fuels containing uranium and the anode electrode (not shown) be positioned in the internal space of the perforated plate. If a current is applied to the anode electrode, uranium metal in the anode basket (6) is dissolved out through the electrolytic process and is electrodeposited on the carbon material cathode (5). As the electrodeposition proceeds, the uranium metal which was electrodeposited on the cathode is collected in the uranium collector (10) by self-weight. At this time, it is preferable that 6 wt % or more uranium trichloride be dissolved in the molten salt (4). More preferably, 8-9 wt % uranium trichloride is dissolved.

According to the present invention, the carbon material cathode (5) may consist of one selected from the group consisting of graphite, glassy carbon or glassy graphite. The carbon material constituting the cathode electrode preferably has a carbon lattice structure and uranium atoms can be intercalated within the lattice. It is preferable that the interfacial distance in the lattice be more than 2.77 Å. In case that the interfacial distance of the carbon lattice is more than the diameter of an uranium atom, as the uranium atom and the carbon material form more intercalated compounds, the interfacial distance of the lattice is expanded and the bond strength of the outermost carbon lattice is decreased. Therefore, if the educed uranium dendrite is grown over a certain amount, it is detached as shown in the step 5 of FIG. 3 by self-weight.

Figure 2:
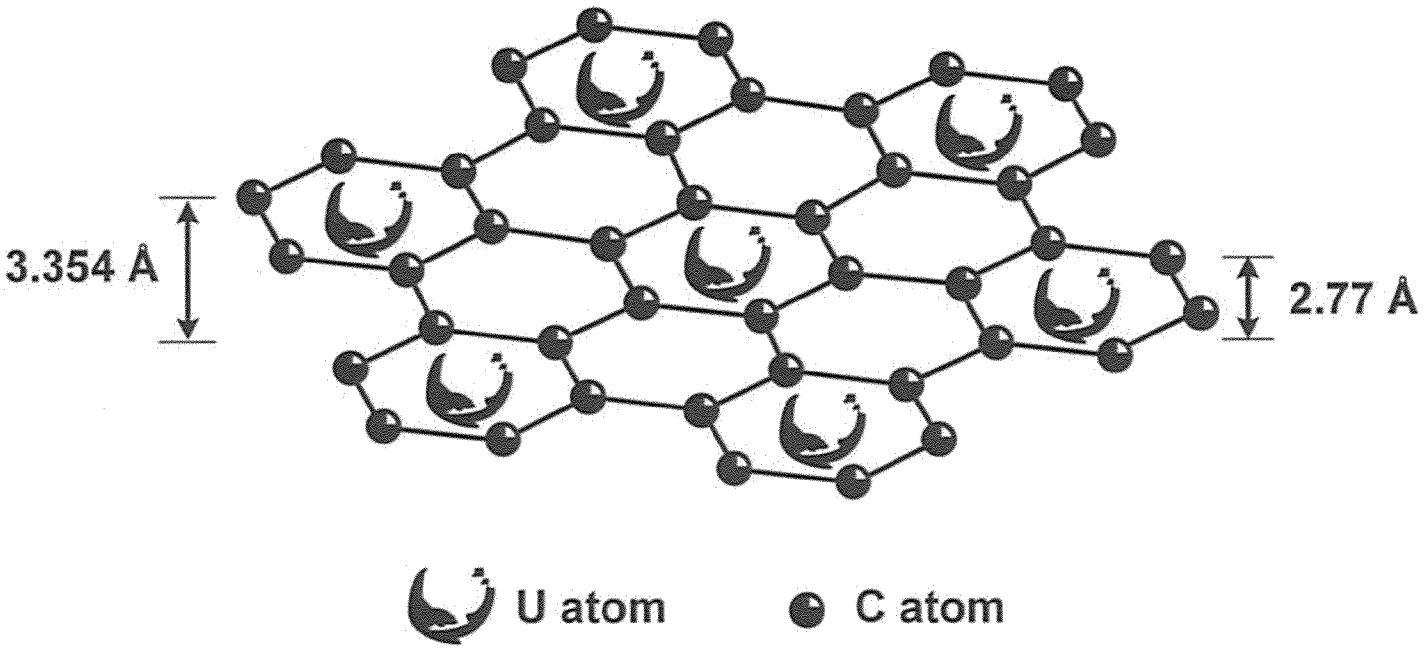
FIG. 2 schematically shows the shape that uranium atoms are infiltrated into a carbon lattice via an intercalation reaction.

FIGS. 2 & 3 show examples using a graphite lattice as a carbon material. The interfacial distance of the graphite lattice is 3.354 Å more than the diameter of an uranium atom being 2.77 Å. As shown in steps 1 to 5 in FIG. 3, the uranium dendrite is grown on a crystal nuclear surface produced in the pristine intercalation reaction in the first place. Accordingly, a pure uranium metal is prepared in the process while the uranium is growing without a continuous polluting graphite. Graphite pollution is negligible. At this time, the increasing uranium electrodeposites expands the interfacial distance of the graphite lattice, leading to lowering the bond strength of the outermost graphite lattice. If the uranium dendrite is grown over a certain amount, it is detached by self-weight.

The internal plan view of the stainless steel reactor (3) of the apparatus for electrorefining uranium metal according to the present invention is shown in the right side of FIG. 1. Likewise, a plurality of carbon material cathodes (5) can be used. It is preferable that they be deposited in a concentric circle around the anode basket (6) in order to maximize the cathode surface area. At this time, an adequate distance should be maintained between the cathodes (5) so that the educed uranium dendrite is grown not to be attached each other before being detached.

In general, when an electrorefining process is carried out, the density of a current applied to an electrode relates to an electrodeposition rate in a cathode and a sticking coefficient. As the current density is increased, a lot of uranium can be electrodeposited for a short time when it comes to the electrolytic rate. The sticking coefficient is defined as the amount of the electrodeposites sticked to a cathode surface to the amount of uranium metal transmitted to the cathode. Therefore, if the current density is increased using the electrode, the electrolytic rate is increased to decrease the sticking coefficient. The magnitude of the current density applied to the apparatus for an electrorefining according to the present invention depends on the content of an allowable electrodeposite, preferably the current density of which the sticking coefficient is 0%. The current density of which the sticking coefficient is 0% may be defined experimentally. For example, a sticking coefficient is 0% if a current density greater than 140 $mA/cm^2$ is applied in a preferred embodiment of the present invention using a single carbon rod as a cathode.

A uranium collector (10) is placed to collect the uranium dendrite detached through the process. The uranium collector (10) preferably uses a stainless steel mesh but is not especially limited to this.

The apparatus for electrorefining of uranium metal according to the present invention having the above constitution can automatically detach the uranium electrodeposites in the cathode by self-weight, thus no additional scrapping apparatus are required. Accordingly, a greater number of cathode electrodes can be placed by removing the scrapping apparatus. The efficiency of electrorefining is proportional to the cathode area and thus a greater number of cathode electrodes can be placed according to the present invention. Therefore, uranium with high efficiency can be refined by a small scale apparatus in a limited space.

Hereinafter, the present invention will be described in detail by means of one preferred embodiment of the present invention. The following embodiment is directed to illustrate the best preferred embodiment of the present invention, but the contents of the present invention are not limited to and by the following embodiment.

Embodiment

Measuring the Amount of Uranium Metal Sticking on the Cathode Surface in Accordance with the Changes of the Density of Applied Currents Molten salt of LiCl—KCl eutectic composition (3 Kg) where approximately 8% of uranium trichloride is dissolved is adjusted at 500° C. in an electrorefiner of which diameter is 15 cm as shown in FIG. 1 and an anode basket including depleted uranium metal segments and a single carbon rod (of which diameter is 1.5 cm) as a cathode are sinked in the molten salt. And then a current is applied to perform an eletrorefining operation for 1 to 2 hours (4 Ah electric current is applied). At this time, 1 wt % of $CeCl_3$ and $NdCl_3$ to molten salt in weight contrast are added prior to the electrorefining operation in order to confirm the pollution in the electrodeposites of rare-earth elements which are fission products included in the spent nuclear fuels.

The below table 1 shows the results of calculating the amount of uranium metal sticking on the cathode surface after the reaction operation is performed in accordance with the changes of current density after the experiment is completed in the following formula.

$$\text{Sticking coefficient} = \frac{\text{amount of electrodeposites sticked on cathode tube}}{\text{amount of metal uranium transmitted to cathode}}$$

TABLE 1

| sticking coefficient | | | | | |
|---|---|---|---|---|---|
| | Current density | | | | |
| | 70 mA/cm$^2$ | 100 mA/cm$^2$ | 120 mA/cm$^2$ | 140 mA/cm$^2$ | 177 mA/cm$^2$ |
| Sticking coefficient | 15.4% | 4.8% | 0.9% | 0% | 0% |

As you can notice in the above table 1, a small amount of uranium electrodeposites which are not completely detached remain until the current density is 100 mA/cm$^2$, but the sticking coefficients are negligible since the current density is 120 mA/cm$^2$.

If the current density is 140 mA/cm$^2$ or more, the electrodeposites are completely removed and collected in a collecting basket and no uranium metal electrodeposites remain in the carbon cathode.

Meanwhile, as the result of analyzing the contents of rare-earth elements using ICP after the salt is cleaned in order to analyze the contents of the rare-earth elements in the electrodeposites, the contents of the rare-earth elements are 10 ppm or less in all the electrorefining conditions. Therefore, it is determined that the rare-earth elements are removed in the $RE+UCl_3 \rightarrow RECl_3+U$ reaction the same as when the metal cathode rod is used.

According to the present invention having the above constitution, it is possible to electrically and chemically resolve the used nuclear fuels at a metal state positioned at the anode in an alkali metal molten salt where a certain amount of uranium trichloride is resolved and to selectively educe only pure uranium using the carbon material cathode.

The existing electrorefining apparatus has a disadvantage of reducing a current efficiency due to a process and a stripping by using complicated mechanical operational parts and an iron frame cathode. However, according to the present invention, a simple electrorefining cell is constituted to include a cathode. Therefore it is possible to maintain the apparatus through a simple repair and improve the efficiency of a current greatly without a stripping process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of preparing uranium metal via an electrorefining of uranium metal, comprising:

applying a predetermined current to an anode electrode included in an anode basket receiving uranium metal segments containing plutonium and minor actinide and a cathode electrode of carbon material within a molten salt containing uranium trichloride;

wherein 8-9 wt % of uranium trichloride is dissolved in the molten salt, wherein the molten salt temperature is about 500° C., and wherein the carbon material is one selected from the group consisting of graphite, glassy carbon and glassy graphite such that the interfacial distance of the carbon lattice is more than the diameter of a uranium atom;

electrodepositing uranium to the cathode electrode in accordance with the reaction initiated by the applied current;

detaching the uranium from the cathode electrode by self scraping, wherein the self scraping is caused by an intercalation of a uranium atom and the carbon material by the expansion of the interfacial distance of the lattice in accordance with the growth of the electrodeposited uranium and the decrease of the bond strength of the outermost carbon lattice; and collecting the detached uranium.

2. A method of preparing uranium metal via an electrorefining of uranium metal, comprising:

applying a predetermined current to an anode electrode having waste fuels comprising uranium metal segments and a cathode electrode of carbon material within a molten salt;

wherein 8-9 wt % of uranium trichloride is dissolved in the molten salt, wherein the molten salt temperature is about 500° C., and wherein carbon lattice of the carbon material is more than the diameter of a uranium atom;

electrodepositing uranium to the cathode electrode in accordance with the reaction initiated by the applied current;

detaching the uranium from the cathode electrode by self scraping, wherein the self scraping is caused by an intercalation of a uranium atom and the carbon material by the expansion of the interfacial distance of the carbon lattice in accordance with the growth of the electrodeposited uranium and the decrease of the bond strength of the outermost carbon lattice.

3. The method of claim 2, wherein the uranium metal segments comprise plutonium and minor actinide.

4. The method of claim 2, wherein the anode electrode is included in an anode basket.

5. The method of claim 2, wherein, the molten salt includes $CeCl_3$ and $NdCl_3$.

6. The method of claim 2, wherein the carbon material comprises graphite.

7. The method of claim 2, wherein the carbon material comprises glassy carbon.

8. The method of claim 2, wherein the carbon material comprises glassy graphite.

9. The method of claim 2, further comprising, collecting the detached uranium.

10. The method of claim 2, wherein, the detached uranium is collected on a uranium collector having a stainless steel mesh.

11. The method of claim 2, wherein, the molten salt includes $CeCl_3$ and $NdCl_3$.

12. A method of preparing uranium metal via an electrorefining of uranium metal, comprising:

applying a predetermined current to an anode electrode having uranium metal segments and minor actinide and a cathode electrode of carbon material within a molten salt;

wherein 8-9 wt % of uranium trichloride is dissolved in the molten salt, wherein the molten salt temperature is about 500° C., and wherein the carbon material is one selected from the group consisting of graphite, glassy carbon and glassy graphite that the interfacial distance of the carbon lattice is more than the diameter of a uranium atom;

electrodepositing uranium to the cathode electrode in accordance with the reaction initiated by the applied current;

detaching the uranium from the cathode electrode by self scraping, wherein the self scraping is caused by an intercalation of a uranium atom and the carbon material by the expansion of the interfacial distance of the lattice in accordance with the growth of the electrodeposited uranium and the decrease of the bond strength of the outermost carbon lattice.

* * * * *